US006524084B2

(12) United States Patent
Neumair

(10) Patent No.: US 6,524,084 B2
(45) Date of Patent: Feb. 25, 2003

(54) MOTOR PUMP UNIT

(75) Inventor: Georg Neumair, Thalhausen (DE)

(73) Assignee: Heilmeier & Weinlein Fabrik fur Oel-Hydraulik GmbH & CO. KG, Munich (DE)

( * ) Notice: Subject to any disclaimer, the term of this patent is extended or adjusted under 35 U.S.C. 154(b) by 0 days.

(21) Appl. No.: 09/795,352

(22) Filed: Mar. 1, 2001

(65) Prior Publication Data

US 2001/0028850 A1 Oct. 11, 2001

(30) Foreign Application Priority Data

Apr. 26, 2000 (DE) ..... 200 07 554 U

(51) Int. Cl.[7] ..... F04B 17/03; F04B 35/04

(52) U.S. Cl. ..... 417/372; 417/368; 417/271; 137/454.4; 137/565.31

(58) Field of Search ..... 417/372, 370, 417/366, 368, 199.1, 228, 271, 201, 205, 206, 423.8, 440; 137/454.2, 454.4, 565.31

(56) References Cited

U.S. PATENT DOCUMENTS 3,992,133 A * 11/1976 Brunner ..... 417/366
4,627,793 A * 12/1986 Kuroyanagi et al. ..... 417/203
4,776,768 A * 10/1988 Konodoh et al. ..... 417/271
5,151,016 A * 9/1992 Her ..... 417/32
5,161,566 A * 11/1992 Scaramucci ..... 137/328
5,181,837 A * 1/1993 Niemiec ..... 417/350

FOREIGN PATENT DOCUMENTS

| | | |
|---|---|---|
| DE | 3839689 | 5/1990 |
| DE | 3931699 | 2/1991 |
| DE | 29519941 | 4/1997 |
| DE | 299 06 881 U1 * | 1/1999 |
| DE | 29906881 | 7/1999 |
| EP | 0890741 | 1/1999 |
| GB | 2000221 | 1/1979 |

* cited by examiner

*Primary Examiner*—Charles G. Freay
*Assistant Examiner*—Han L. Liu
(74) *Attorney, Agent, or Firm*—Finnegan, Henderson, Farabow, Garrett & Dunner, L.L.P.

(57) ABSTRACT

A motor pump aggregate M has a housing 1 defining an oil reservoir with first and second chambers R1, R2. An electromotor 2 is driving via its motor shaft W at least one radial piston pump arrangement P1 provided within said first chamber R2. Both chambers R1, R2 are separated by a separation wall 7. A filling and pressure biasing system V is provided for said first chamber R1 in order to adjust within said first chamber R1 a predetermined oil filling level and a pre-selected oil pressure pre-biasing for said radial piston pump arrangement P1.

12 Claims, 3 Drawing Sheets

MOTOR PUMP UNIT

BACKGROUND OF THE INVENTION

1. Field of the Invention

The present invention relates to a motor pump unit in which a housing has first and second chambers defining an oil reservoir separated by a separation wall, and an electric motor for driving a radial piston pump arrangement within the first chamber.

2. Description of the Related Art

In the motor pump unit disclosed in DE 299 06 881 U, oil returning from a hydraulic system either directly flows into a first chamber or finally flows into the first chamber from a second chamber via a lower open passage in a separation wall between the first and second chambers. In a horizontal operation position of the motor pump unit the same filling level is achieved in both chambers. A ventilation bore situated in an upper portion of the separation wall allows air to pass through. The ventilation bore has a significantly smaller cross-section than the passage in the separation wall. A radial piston pump provided within the first chamber has to generate extremely high hydraulic pressures with small supply rate, e.g., between 700 bars and 800 bars. After long resting periods of the motor pump unit, or when tilting or moving the motor pump unit, air can be trapped in the oil. The intrusion of trapped air cannot be avoided reliably even by using downwardly extending suction tubes for the radial piston pump elements. As the pistons of the radial piston pump elements are made with small diameters, any trapped air leads to a significant decrease of the supply efficiency of the radial piston pump such that a desired maximum pressure cannot be reached.

Further publications relating to motor pump units are GB 20 00 221 A, DE 295 19 941A, DE 39316 99A, EP 0890 741A, and DE 38 39 689 A.

SUMMARY OF THE INVENTION

It is an object of the invention to provide such a motor pump unit with increased supply efficiency to reliably reach the needed maximum pressure under all operating conditions.

By a filling and pressure pre-biasing system associated with the first chamber for all operating conditions, not only is the predetermined filling level reliably maintained in the first chamber, but also, a hydraulic biasing pressure is generated at the suction side of the radial piston pump arrangement. The measures significantly increase the supply efficiency of the radial piston pump arrangement and avoids air getting trapped in the radial piston pump elements. The hydraulic pre-biasing pressure also allows the small diameter pump elements to automatically remove occasionally trapped air. Due to the increased supply efficiency extremely high pressures of, e.g., 700 bars to 800 bars can be reached reliably by radial piston pump elements having small pistons and operating with small supply rates. The unit predominantly is developed for operation with horizontal motor shaft (lying working position). However, the concept of the pressure pre-biasing is of advantage also for units operating in upright position.

A spring loaded pre-biasing valve allows an oil exchange from the first chamber into the second chamber via the exchange flow channel only when the adjusted pre-biasing pressure is reached within the first chamber. Air present within the first chamber is transferred via the ventilation channel into the second chamber. The filling level within the first chamber is raised at least up to the height position of the ventilation channel. Oil returning from a return system into the first chamber is under a certain return pressure from which the pre-biasing valve derives the intended prebiasing pressure for the first chamber. The return oil volume furthermore presses residual air from the first chamber via the ventilation channel into the second chamber. Even after a longer resting period of the motor pump unit and/or in case of movements of the unit during transport and/or in case of preliminary strong oil supply demand no air is allowed to entered the radial piston pump arrangement. In case that nevertheless air should be trapped for other reasons the radial piston pump elements even are able to automatically remove trapped air more easily thanks to the pre-biasing pressure within the first chamber. Alternatively or additively the needed pre-biasing pressure and the predetermined filling level also can be achieved by means of a charging pump.

A pre-biasing valve having the form of a screw-in check valve within the separation wall is easy to manufacture and to mount. Screw-in check valves are available for fair costs, only need little mounting space, and are very reliable in function.

Compact dimensions, a stable heat threshold even for permanent operation, and manufacturing the motor pump units for fair costs are possible if the stator winding section of the electric motor designed as an oil immersed motor directly is shrunk into the light metal profile section forming a part of the housing or the oil reservoir, respectively.

At least a flattened section in the periphery of the stator winding part of the motor forms an oil exchange passage through which oil, for example, can be brought to a motor shaft bearing situated remote from the radial piston pump arrangement. Except in the region of the at least one peripheral flattened part, a direct metallic contact is achieved between the stator winding part and a light metal profile section. By the direct metallic contact, heat from the stator winding part is conveyed to the outer side without an insulating oil film between the stator winding part and the light metal profile section. The heat conveyed outwardly then is radiated off by a rib structure and/or is removed with the help of a fan.

The ventilation channel ought to be provided higher up than the suction areas, particularly the suction area located high up of the several radial piston pump elements distributed around the pump shaft. The ventilation channel ought to be located very close to the upper boundary of the first chamber. The oil exchange channel, to the contrary, can be located at the height position of the motor or pump shaft.

A significant improvement of the supply sufficiency already can be achieved by a relatively moderate pre-biasing pressure of about 0.1 bar within the first chamber. Preferably, the pre-biasing pressure is generated by means of the returning oil having the return system pressure. However, alternatively or additively the prebiasing pressure can be generated by means of a charging pump.

A charging pump is preferably driven from the same motor shaft as the other pump sections and is received within the first or second chamber.

Radial piston pump elements having piston diameters between 4 mm and 9 mm are employed to achieve the needed maximum pressure. In this case maximum pressures from about 700 bars to 800 bars can be reached by relatively low driving power. A moderate driving power is preferable for the start-up current of the electric motor in order to allow connection of the motor pump unit as a portable unit to the normal electric power supply without overloading the usual relatively weak fuses usually provided. The motor pump unit is preferably a portable unit with a weight less than about 25 kilos.

In order to simplify the first filling of the first chamber and in order to allow to easily remove the oil a further passage containing a check valve is provided in the separation wall. The check valve blocks in flow direction from the first chamber to the second chamber and opens with relatively low resistance in the opposite flow direction. An oil outlet to a removal screw can be connected to the removal passage, such that the first chamber can be filled when filling the second chamber.

Structurally simple the seat of the check valve directly is formed within the removal passage. A closure ball is co-operating with the seat. The closure ball is secured by means of a securing ring against being lost. Preferably, an oil removal screw can be provided in the second chamber.

BRIEF DESCRIPTION OF THE DRAWINGS

Embodiments of the invention will be explained with the help of the drawings. In the drawings.

DETAILED DESCRIPTION OF THE ILLUSTRATED EMBODIMENT

Figure 1:
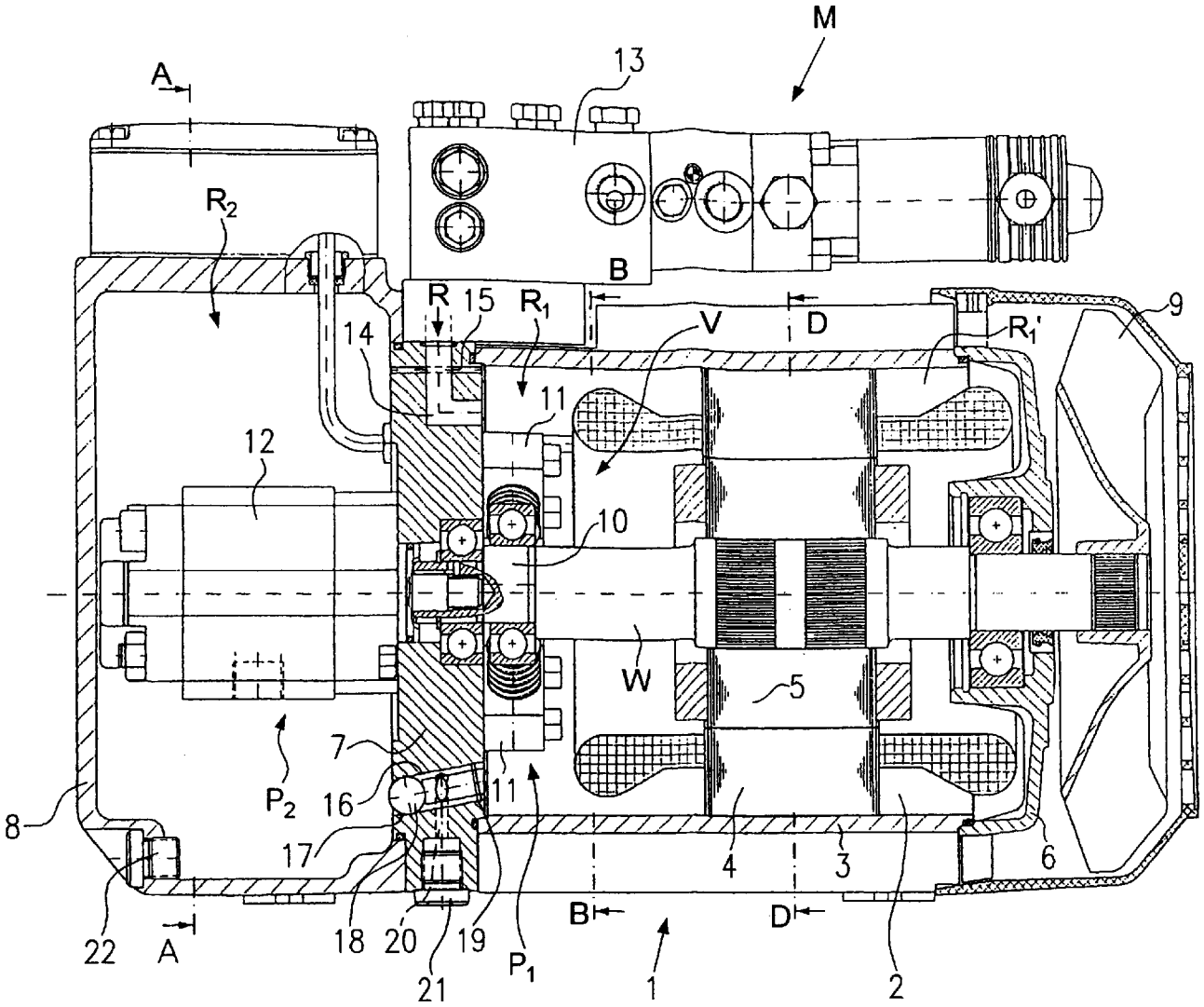
FIG. 1 is a longitudinal section of a motor pump unit.

A motor pump unit M in FIG. 1, e.g., is a portable unit having a weight below about 25 kilos and is intended for a lying operation position. The motor pump unit, however, does not need to be necessarily a portable unit. Furthermore, it can be developed for an upright operation position.

In a housing 1 confining an oil reservoir an electric motor 2 is situated. The electric motor 2 is designed as an oil immersible motor and serves as a drive for a radial piston pump arrangement P1 (high pressure stage) and a low pressure stage P2, e.g., defined by a gear wheel pump 12. A motor shaft W is situated essentially horizontally. Housing 1 includes a light metal profile section 3 (rib tube) with cylindrical inner wall. A stator winding part 4 of electric motor 2 directly is shrunk into the light metal profile section 3. A rotor 5 is centered within stator winding part 4 on motor shaft W. Motor shaft W is supported in bearings in an end cap 6 and a separation wall 7 of the housing 1. A further housing part 8 is fixed to separation wall 7. Separation wall 7 separates a first chamber R1 of the oil reservoir from a second chamber R2. Pump stage P2 is secured to separation wall 7 within second chamber R2. The stator winding part 4 separates the first chamber R1 from a further chamber R1'. Motor shaft W extends through the further chamber R1' and through a bearing located within the end cap 6 towards an exteriorly positioned fan wheel 9. For example, by means of an eccentric 10, motor shaft W drives several radial piston pump elements 11 which are distributed around the motor shaft W within the radial piston pump arrangement P1. There are, e.g., four radial piston pump elements 11 which are secured to the separation wall 7. The term "radial piston pump element" means that each pump element contains a linearly reciprocable piston driven in radial direction from the axis of motor shaft W. Motor shaft W further drives the gear wheel pump 12. The pump arrangements P1, P2, e.g., are connected inside separation wall 7 with a control valve block 13 which, e.g., is mounted to the exterior side of housing 1. A return channel 14 connected to a return system R extends within separation wall 7 towards the first chamber R1. In an upper portion of separation wall 7 a ventilation channel 15 interconnects both chambers R1, R2.

In a lower portion of separation wall 7 a removal channel 16 is provided, e.g., in the form of a bore extending obliquely downwardly from first chamber R1 into second chamber R2. Within the removal channel 16 a valve seat 17 is provided, e.g., integrally formed, onto which a ball closure member 18 can be seated. Valve seat 17 and ball closure member 18 define a check valve blocking in flow direction towards the second chamber R2 and opening in case of a weak pressure difference into the opposite flow direction towards the first chamber R1. The ball closure member 18 is secured by a securing ring 19 against falling out, e.g., a Seeger ring. A drain 20 extends from removal channel 16 to a lower removal screw 21. Also in housing part 8, a lower removal screw 22 can be provided.

A filling and pressure pre-biasing system V is provided for the first chamber R1. The system comprises in FIGS. 2, 3 and 4 a pre-biasing valve F situated within the separation wall 7, furthermore, e.g., the return channel 14 connected to the return system R, and the ventilation channel 15. The filling and pressure biasing system V serves to generate a predetermined filling level and a selected hydraulic prebiasing pressure within the first chamber R 1 in operation of the motor pump unit, in order to improve the supply efficiency of the unit.

Figure 2:
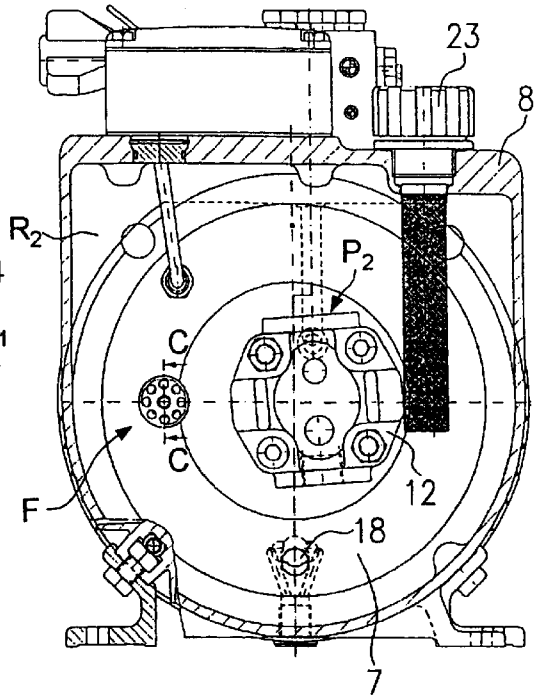
FIG. 2 is a cross-sectional view of the motor pump unit of FIG. 1 in sectional plane A—A in FIG. 1.
Figure 3:
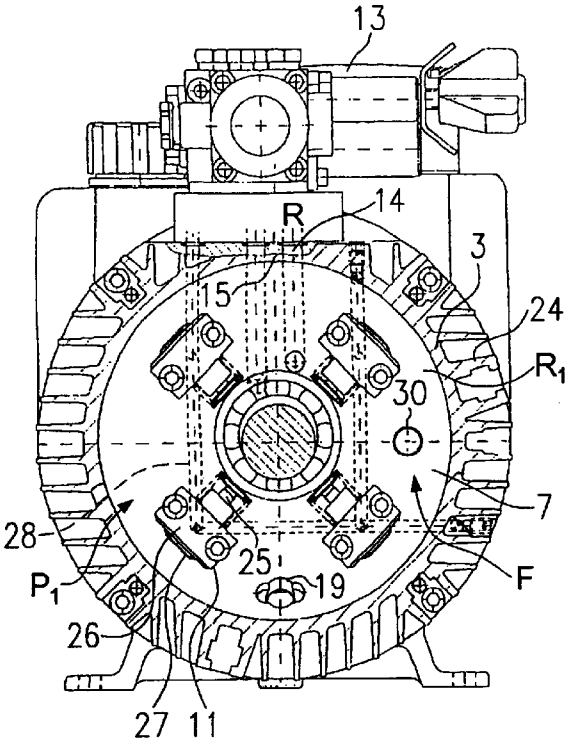
FIG. 3 is a cross-sectional view of the motor pump unit in sectional plane B—B in FIG. 1.

In FIGS. 2 and 3 the pre-biasing valve F is located substantially at the height position of the motor shaft W. FIG. 2 shows a filling device 23 for the second chamber R2. In FIG. 3 the pre-biasing valve F is located within an exchange channel 30 in separation wall 7. The radial piston pump arrangement P1 has four radial piston pump elements 11, each of which has a piston 25, a housing 26 and a suction side 27.

The pressure sides of elements 11 are connected via a channel system 28 in separation wall 7 to control valve block 13. Pistons 25, e.g., are made with a diameter between 4 mm and 9 mm. Return channel 14 in separation wall 7 leads from the return system R into the first chamber R1.

Figure 4:
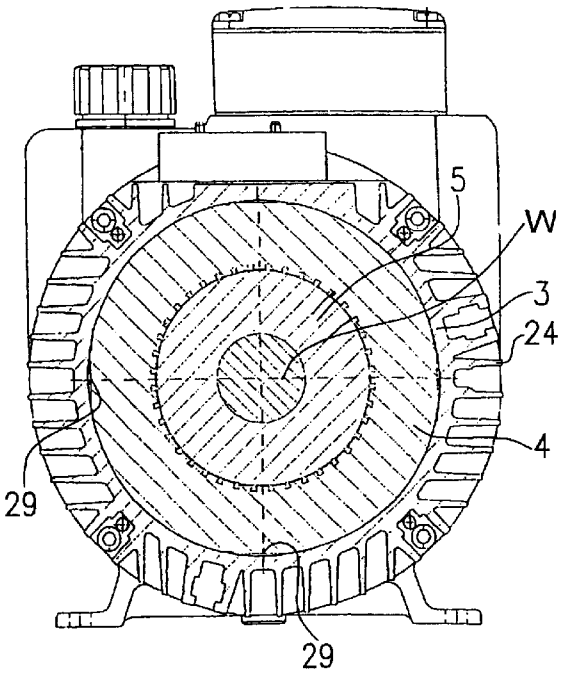
FIG. 4 is a cross-sectional view of the motor pump unit in sectional plane D—D in FIG. 1.

In FIG. 4 the stator winding part 4 is shrunk directly into the light metal profile section 3 such that flattened portions 29 at the periphery of the stator winding part 4 are defining oil passages to the further chamber R1' and to a bearing of motor shaft W situated at the right side in FIG. 1. In this way, a dominant part of the circumference of stator winding part 4 is contacting without an oil film in-between the cylindrical inner wall of the profile section 3, which is formed with exterior longitudinal ribs 24.

Figure 5:
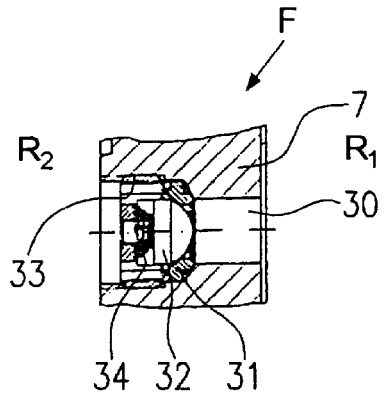
FIG. 5 is a more detailed longitudinal sectional view in sectional plane C—C in FIG. 2.

The pre-biasing valve F (FIG. 5), e.g., is inserted from the second chamber R2 into the exchange channel 30. In a stepped bore having a terminal inner thread section a valve seat insert 31 is seated, which is positioned by means of a screwed-in closure spring-retainer 33 and is connecting with a closure element 32 preferably having a spherical sealing surface. The closure element 32 is loaded by a pre-loading spring 34 in closing direction (screw-in check valve).

Figure 6:
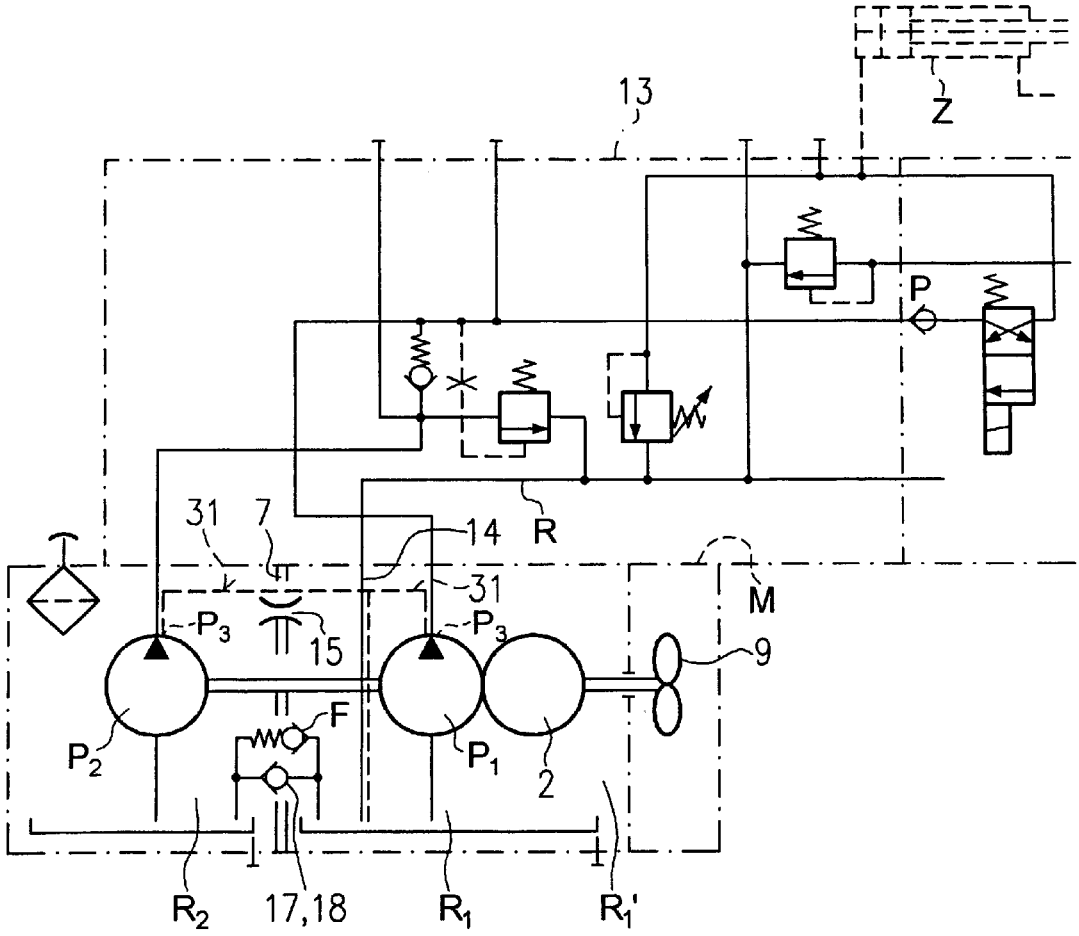
FIG. 6 is a schematic block diagram of the circuit of the motor pump unit with mounted control valve block and a connected to hydro-consumer, wherein within the block diagram, an alternative or additive variation is indicated in dotted lines.

In block diagram circuitry in FIG. 6, the pre-biasing valve F and the check valve 17, 18 in separation wall 7 block oil flow in mutually opposite flow directions. The ventilation channel 15 forms a throttled connection between the first and second chambers R1, R2. The return system R of the hydraulic system (not shown) is connected to return channel 14. Control components of the hydraulic system may be received within control valve block 13. A multi-way control valve can be connected to the control valve block 13 as well as a connection towards a hydraulic consumer Z. Within return system R, at least during operation, a predetermined return system pressure is active. Oil returning into return channel 14 and the return system pressure are used to produce within the first chamber R1 a filling level up to at least the height position of ventilation channel 15 and to generate a pre-selected pre-biasing pressure, respectively, which is controlled by the pre-biasing valve F. Oil passes from the first chamber R into the second chamber R2 as soon as the pressure within the first chamber R1 tends to exceed the predetermined or selected pre-biasing pressure. The pre-biasing pressure, e.g., is adjusted to 0.1 bar.

As an alternative solution a charging pump P3 is indicated in dotted lines either in the first or the second chamber R1, R2. The charging pump P3 is supplying the first chamber R1 with oil in order to generate the filling level and prebiasing pressure. Instead an external charging pump or another charging pressure source could be used for this purpose.

What is claimed is:

1. A motor pump unit comprising:

a housing enclosing a first chamber and a second chamber communicating with each other in the housing, said first and second chambers defining a common oil reservoir;

an electric motor having a motor shaft within said housing;

at least one radial piston pump arrangement provided within said first chamber and drivable by said motor shaft;

a separation wall between said first and second chambers;

means for supplying pressurized oil to said first chamber; and a filling and pressure biasing system associated with said first chamber and including a pre-biasing valve located in an oil outlet channel of said first chamber for inhibiting a flow of the oil supplied to said first chamber via said pressurized oil supply means until a pre-selected oil level and a pre-selected pre-biasing oil pressure are reached in said first chamber, and allowing flow of oil out of said first chamber through said outlet channel only when said predetermined oil level and said pre-selected prebiasing pressure are maintained in said first chamber during operation of the motor pump unit, said oil level and said biasing oil pressure being pre-selected such that said radial piston pump arrangement is supplied with oil substantially without any air entrapped in the oil during operation of said motor pump unit.

2. The motor pump unit as in claim 1, wherein said means for supplying pressurized oil to said first chamber comprises either an oil return system or a charging pump connected to said first chamber in said motor pump unit.

3. The motor pump unit as in claim 2, wherein said charging pump is located within said first or said second chamber and is driven by said motor shaft.

4. The motor pump unit as in claim 1, wherein said pre-biasing valve is located in an exchange channel in said separation wall for connecting said first and said second chambers at a predetermined elevation, wherein said pre-biasing valve is spring loaded to a blocking position counter to said pre-selected pre-biasing pressure in said first chamber wherein a permanently open ventilation channel is provided within said separation wall at a higher elevation than said exchange channel, and wherein said pre-biasing valve, in a blocking position, blocks any oil flow in a direction from said second chamber into said first chamber.

5. The motor pump unit as in claim 4, wherein said pre-biasing valve is a screw-in check valve unit comprising a valve seat insert, a screw-in spring retainer, a preloading spring, and a closure element having a spherical sealing surface for coaction with said valve seat insert.

6. The motor pump unit as in claim 1, wherein said housing includes a tubular metal profile section having a cylindrical inner wall and exterior cooling ribs, wherein a stator winding part of said electric motor is directly secured in place by a shrink connection with said metal profile section inner wall, wherein said electric motor shaft extends substantially coaxial with said tubular metal profile section, and wherein said stator winding part is provided with at least one peripheral flat portion, said flat portion and said cylindrical inner wall commonly defining another oil exchange passage.

7. The motor pump unit as in claim 1, wherein said radial piston pump arrangement includes a plurality of radial piston pump elements distributed around said motor shaft and secured to said separation wall, wherein each radial piston pump element has an oil inlet, and wherein, in the operating position of said motor pump unit with said motor shaft extending substantially horizontally, said ventilation channel is located at a higher elevation than the highest positioned oil inlet of said radial piston pump elements, while said exchange channel is located essentially at the same elevation as said motor shaft.

8. The motor pump unit as in claim 1, wherein said pre-biasing valve is set to limit said pre-selected pre-biasing pressure of about 0.01 bar within said first chamber.

9. The motor pump unit as in claim 1, wherein a low pressure gear wheel pump arrangement is provided in said second chamber.

10. The motor pump unit as in claim 1, wherein each radial piston pump element has a piston of a diameter between 4 mm to about 9 mm.

11. The motor pump unit as in claim 1, wherein an oil removal channel is formed within said separation wall, said removal channel extending in the operating position of said motor pump unit with an essentially horizontally oriented motor shaft from said first chamber, obliquely downwards into said second chamber, wherein a check valve is arranged within said removal channel, said check valve blocking flow in a direction from said first chamber into said second chamber, and wherein a drain channel branches off from said removal channel and extends to a removal screw positioned in said housing at a lower elevation than said oil removal channel.

12. The motor pump unit as in claim 11, wherein said check valve comprises a ball shaped closure member and a valve seat directly formed in said removal channel and wherein said closure member is trapped within said removal channel by securing a ring-like retainer inserted into said removal channel at an end portion thereof remote from said valve seat.

* * * * *